US007736284B1

(12) United States Patent
Andrews

(10) Patent No.: US 7,736,284 B1
(45) Date of Patent: Jun. 15, 2010

(54) HAND-GRIP ACCESSORY

(76) Inventor: George S. Andrews, P.O. Box 3098, Cedar Hill, TX (US) 75106

( * ) Notice: Subject to any disclaimer, the term of this patent is extended or adjusted under 35 U.S.C. 154(b) by 697 days.

(21) Appl. No.: 11/072,975

(22) Filed: Mar. 7, 2005

(51) Int. Cl.
*A63B 21/072* (2006.01)

(52) U.S. Cl. ..... 482/108; 482/49; 482/92; 482/139

(58) Field of Classification Search ..... 482/49, 482/50, 104–106, 108, 109, 139, 44, 74, 482/124; 2/20; 16/25, 438, 435; 294/25
See application file for complete search history.

(56) References Cited

U.S. PATENT DOCUMENTS

| | | | | | |
|---|---|---|---|---|---|
| 300,857 | A * | 6/1884 | Evans | 182/192 |
| 2,876,486 | A * | 3/1959 | Lindstrom | 16/421 |
| 2,984,486 | A | 5/1961 | Jones | |
| 4,262,385 | A * | 4/1981 | Norman | 16/411 |
| 4,639,979 | A | 2/1987 | Polson | |
| 4,867,444 | A * | 9/1989 | Castillo | 482/106 |
| 4,890,355 | A | 1/1990 | Schulten | |
| 5,222,926 | A * | 6/1993 | Eggen | 482/49 |
| 5,415,607 | A * | 5/1995 | Carpenter | 482/106 |
| 5,681,243 | A * | 10/1997 | Criss | 482/49 |
| 5,775,756 | A | 7/1998 | Rozenich | |
| 5,797,165 | A * | 8/1998 | Armbrust | 16/430 |
| 6,183,400 | B1 * | 2/2001 | Pope | 482/92 |
| 6,200,244 | B1 * | 3/2001 | Cook | 482/105 |
| 6,224,518 | B1 * | 5/2001 | Weiss et al. | 482/93 |
| D448,663 | S | 10/2001 | Raftree | |
| 6,604,789 | B1 * | 8/2003 | Downing | 297/227 |
| 6,719,342 | B2 | 4/2004 | Shinmoto et al. | |
| 7,387,324 | B1 * | 6/2008 | Sharpe | 294/171 |
| 2001/0052710 | A1 | 12/2001 | Witherell | |
| 2002/0072455 | A1 * | 6/2002 | Akins | 482/93 |

* cited by examiner

*Primary Examiner*—Loan H Thanh
*Assistant Examiner*—Victor K Hwang

(57) ABSTRACT

A hand-grip accessory includes a body having a deformably resilient cylindrical shape provided with open end portions and an axial bore formed therebetween. The body further has separable longitudinal edge portions adapting the body between expanded and equilibrium arrangements such that the apparatus can be nested about a dumbbell. The accessory further includes a mechanism for tethering the body to a user's wrist such that the apparatus can be maintained within a restricted spatial distance from the user during operating conditions. The tethering mechanism includes a lanyard having oppositely situated looped end portions securely coupled to the body and removably positional about the user's wrist respectively. One of the looped end portions has a fixed diameter while another of the looped end portions preferably includes a coupling slidably mated to the lanyard.

10 Claims, 3 Drawing Sheets

HAND-GRIP ACCESSORY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to gripping apparatuses and, more particularly, to a hand-grip accessory for improving a weightlifter's grip and protecting his/her hands.

2. Prior Art

Maintaining a secure comfortable grip is extremely important when operating or using various hand held apparatuses. For example, a secure grip is particularly important when using weightlifting equipment, such as a weightlifting bar or dumbbells. A secure grip on the weightlifting bar or the handle of the dumbbell can facilitate the use of greater weight, or increase the number of repetitions made during a particular exercise. Additionally, a secure grip is necessary to avoid accidentally dropping the weightlifting bar or dumbbell, which could result in injury to the user or others, or damage to the exercise equipment.

One method used by weightlifters to provide a secure grip is to coat their hands with rosin. This will make the weightlifter's hands sticky and allow the weightlifter to grip the bar without slipping. However, rosin has a tendency to build up on the weightlifting equipment which necessitates periodically cleaning the equipment to remove the built-up rosin.

Weightlifting gloves are also used by weightlifters to provide a more secure grip on the weightlifting bar. Some gloves are padded to provide a limited amount cushioning in the palm area. However, use of weightlifting gloves increases sweating of the hands during exercising, which permeates the gloves. When the sweat dries, the gloves can become stiff and useless.

Another method used to provide a secure grip is to add a rough textured surface on the weightlifting bar. However, a rough textured surface can cause blistering or abrasions on the hands.

Some weightlifting equipment includes a cushioned surface permanently attached to the bar or handle area. However, placement of such a surface significantly increases the price of the weightlifting equipment. Further, the permanently placed surface cannot be removed and used on other weightlifting equipment or apparatuses.

Canvas strips have also been utilized to provide a secure grip on a weightlifting bar. A portion of a canvas strap, approximately 1.5 inches wide, is wrapped around the wrist, and the remaining portion is wrapped around the weightlifting bar. However, the strap must be unwrapped each time the user leaves the bar and rewrapped for the next use.

Accordingly, a need remains for a gripping apparatus to overcome the above-noted shortcomings. The present invention satisfies such a need by providing a hand-grip accessory that improves a weightlifter's grip on a bar or dumbbell and protects his/her hands. Such an accessory prevents a weightlifter from developing blisters or calluses while aiding performance.

BRIEF SUMMARY OF THE INVENTION

In view of the foregoing background, it is therefore an object of the present invention to provide an apparatus for providing weightlifters a secure gripping surface when handling a dumbbell and the like. These and other objects, features, and advantages of the invention are provided by an apparatus including a body having a deformably resilient cylindrical shape provided with a centrally disposed longitudinal axis extending along a length thereof. Such a body further has open end portions and an axial bore formed therebetween for defining a sleeve through with the dumbbell can be slidably registered. The body further has separable longitudinal edge portions adapting the body between expanded and equilibrium arrangements such that the apparatus can be nested about the dumbbell. The longitudinal edge portions extend parallel to each other and maintain a uniform spatial relationship when the body is at equilibrium.

The apparatus further includes a mechanism for tethering the body to a user's wrist such that the apparatus can be maintained within a restricted spatial distance from the user during operating conditions. Such a tethering mechanism is formed from flexible, elastic material, adjustably adaptable between alternate lengths. The tethering mechanism includes a lanyard having oppositely situated looped end portions securely coupled to the body and removably positional about the user's wrist respectively. One of the looped end portions has a fixed diameter while another of the looped end portions preferably includes a coupling slidably mated to the lanyard such that the user may adapt such a looped end portion between alternate diameters by communicating the coupling along a length of the lanyard.

The body includes a plurality of monolithically formed layers having varying thicknesses respectively. An outer one of the body layers preferably includes a plurality of vinyl strips registered about the opposed end portions of the body respectively. An inner one of the body layers is preferably formed from non-skid rubber material having a unitary and continuous shape extending along an entire length of the axis. A medial one of the body layers is partially interfitted between the inner and outer body layers such that a user can maintain surface area contact with the medial body layer without engaging the outer body layer. The medial body layer is preferably formed from impact-absorbent foam and has a thickness greater than associated thicknesses of the outer and inner body layers. The body may be provided with an aperture juxtaposed with one of the end portions thereof for receiving the lanyard therethrough.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
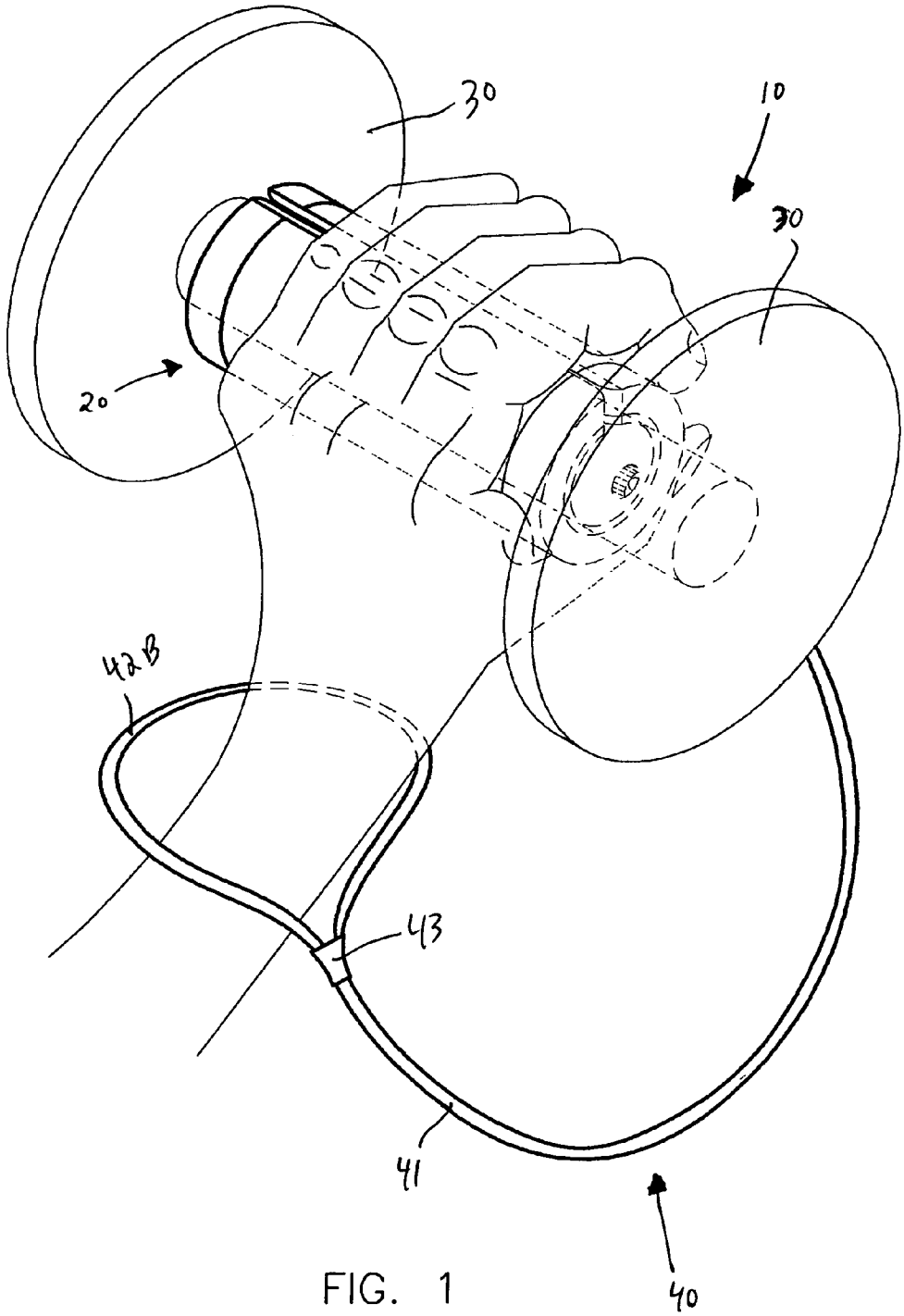
FIG. 1 is a perspective view showing a hand-grip accessory in a preferred environment, in accordance with the present invention.
Figure 2:
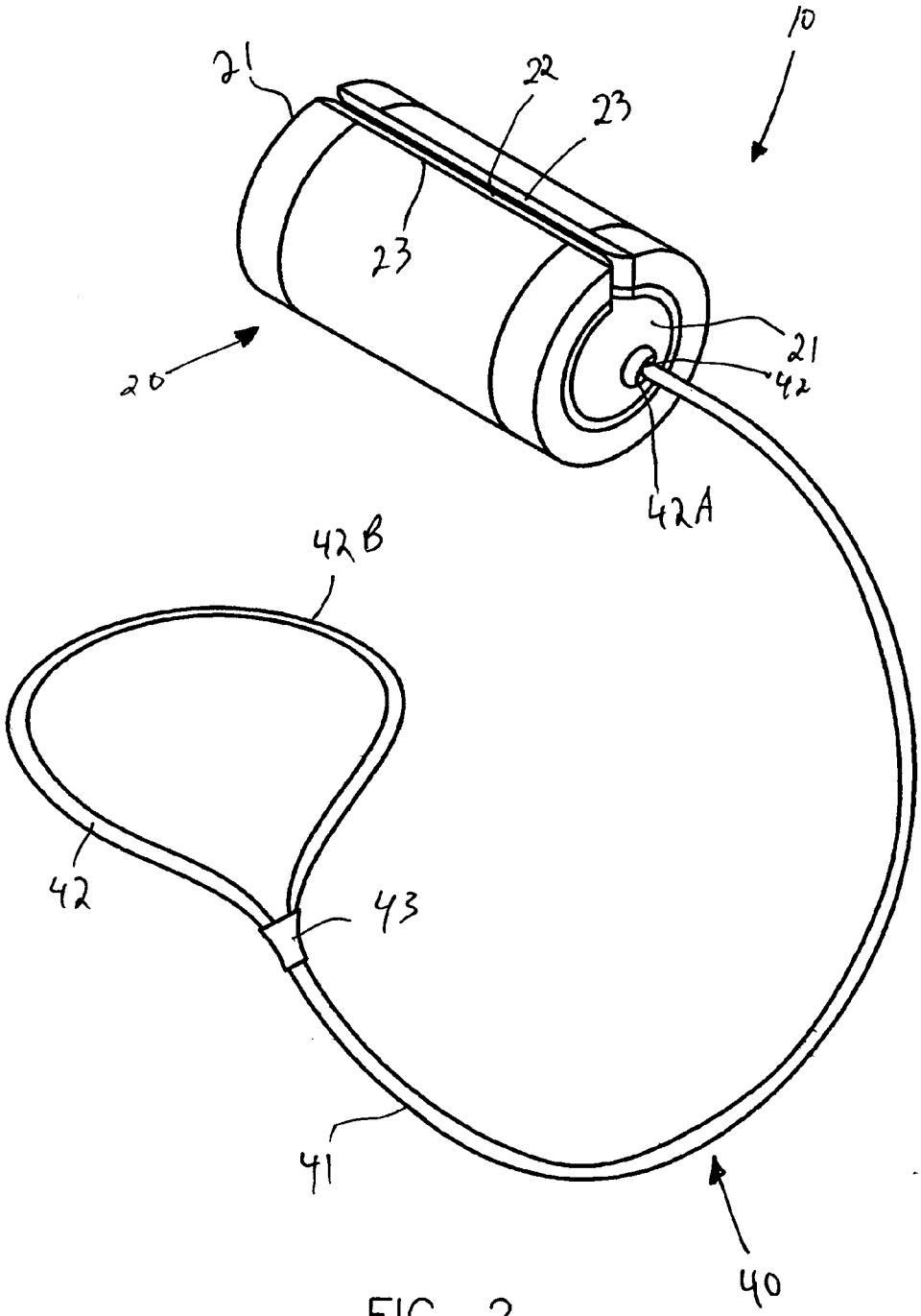
FIG. 2 is a perspective view of the invention shown in FIG. 1.
Figure 3:
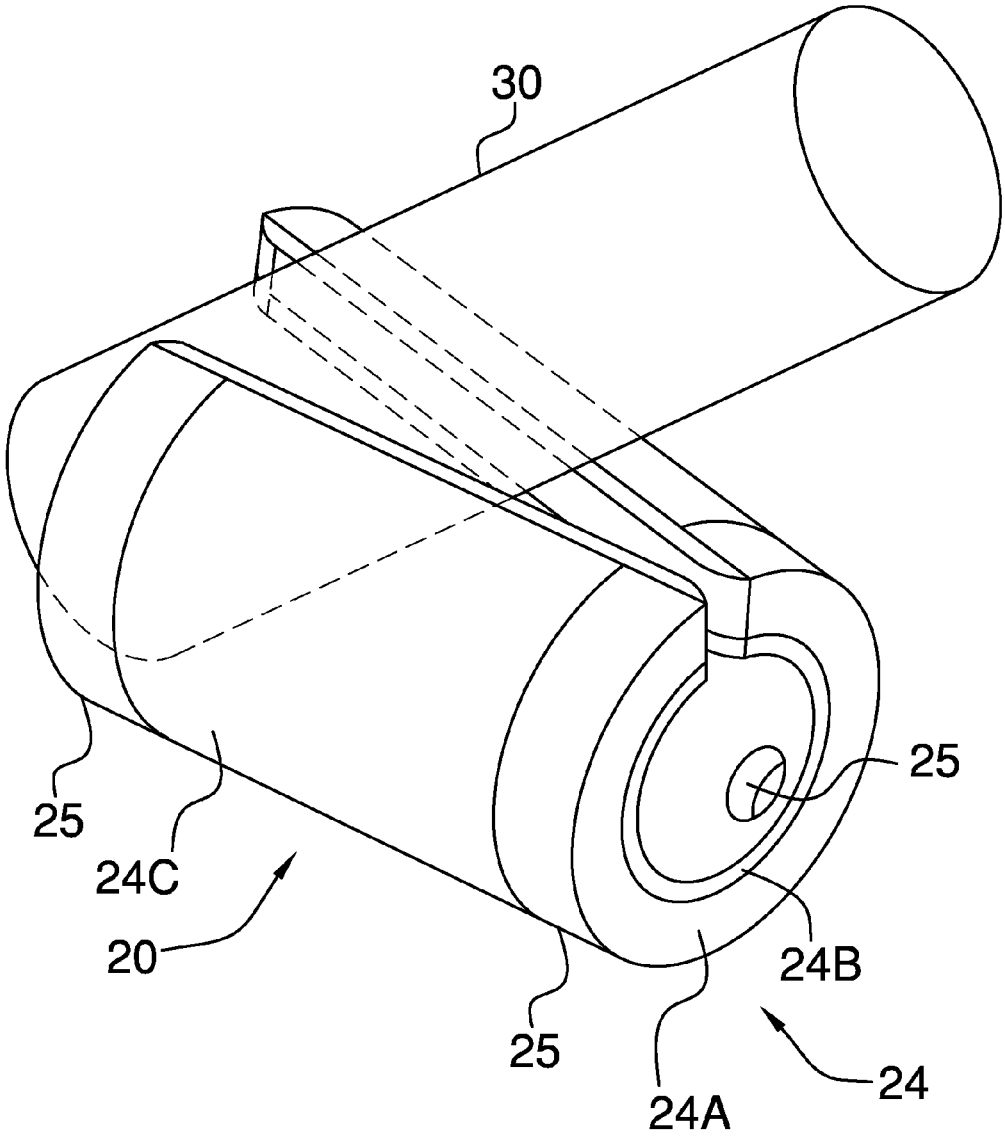
FIG. 3 is an enlarged perspective view illustrating a dumbbell being slidably registered through the sleeve.

The apparatus of this invention is referred to generally in FIGS. 1-3 by the reference numeral 10 and is intended to provide a hand-grip accessory for weightlifter. It should be understood that the apparatus 10 may be used to improve the grip on many different objects and should not be limited to only dumbbells.

Initially referring to FIG. 2, the apparatus 10 includes a body 20 having a deformably resilient cylindrical shape provided with a centrally disposed longitudinal axis (not shown) extending along a length thereof. Such a body 20 further has open end portions 21 and an axial bore 22 formed therebetween for defining a sleeve through which the dumbbell 30 can be slidably registered, as shown in FIG. 3. The body 20 further has separable longitudinal edge portions 23 adapting the body 20 between expanded and equilibrium arrangements such that the apparatus 10 can be nested about the dumbbell 30. The longitudinal edge portions 23 extend parallel to each other and maintain a uniform spatial relationship when the body 20 is at equilibrium. The body 20 may be produced in various sizes for small or large hands and in a wide range of color combinations for an attractive appearance.

Referring to FIGS. 1 and 2, the apparatus 10 further includes a mechanism 40 for tethering the body 20 to a user's wrist such that the apparatus 10 can be maintained within a restricted spatial distance from the user during operating conditions. Such a tethering mechanism 40 is formed from flexible, elastic material adjustably adaptable between alternate lengths. The tethering mechanism 40 includes a lanyard 41 having oppositely situated looped end portions 42 securely coupled to the body 20 and removably positional about the user's wrist respectively. Such a lanyard 41 makes the apparatus 10 easy to hold between sets, ensuring that a user will not have to look around the gym for a misplaced or lost apparatus 10, saving time and frustration.

One of the looped end portions 42A has a fixed diameter while another of the looped end portions 42B preferably includes a coupling 43 slidably mated to the lanyard 41 such that the user may adapt the looped end portion 42B between alternate diameters by communicating the coupling 43 along a length of the lanyard 41. The lanyard 41 is preferably formed from cotton or nylon, but may be formed from other similar material, as is obvious to one having ordinary skill in the art.

Referring to FIG. 3, the body 20 includes a plurality of monolithically formed layers 24 having varying thicknesses respectively. An outer one 24A of the body layers 24 preferably includes a plurality of vinyl strips 25 registered about the opposed end portions 21 of the body 20 respectively. Such outer layer 24A is preferably formed from durable rubber or vinyl. An inner one 24B of the body layers 24 is formed from non-skid rubber material having a unitary and continuous shape extending along an entire length of the axis. Such inner layer 24B is preferably formed durable rubber. A medial one 24C of the body layers 24 is partially interfitted between the inner 24B and outer 24A body layers such that a user can maintain surface area contact with the medial body layer 24C without engaging the outer body layer 24A. The medial body layer 24C is preferably formed from impact-absorbent foam for absorbing the shocks associated with weightlifting and has a thickness greater than associated thicknesses of the outer 24A and inner 24B body layers. By absorbing the force, the body 20 protects a user's hands, eliminating the pain and discomfort often associated with heavy lifts. The body 20 may be provided with an aperture 44 juxtaposed with one of the end portions 21 thereof for receiving the lanyard 41 therethrough.

The apparatus 10 helps prevent a weightlifter from developing blisters or calluses on their hands. A weightlifter can wear gloves to protect his/her hands, but gloves only cover a portion of the fingers. Even with gloves on, a lifter may still develop blisters or calluses as his/her grips loosen during consecutive repetitions. The apparatus 10 provides full protection for a lifter's palm and fingers. When finished lifting, a user simply pulls the apparatus 10 off the dumbbell.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. An apparatus for providing weightlifters a secure gripping surface when handling a dumbbell and the like, said apparatus comprising:

a body having a deformably resilient cylindrical shape provided with a centrally disposed longitudinal axis extending along a length thereof, said body further having opposed open end portions and an axial bore formed therebetween for defining a sleeve through which the dumbbell can be slidably registered, said body further having separable longitudinal edge portions adapting said body between expanded and equilibrium arrangements such that said apparatus can be nested about the dumbbell, wherein said body comprises: a plurality of monolithically formed layers having varying thicknesses respectively, an outer one of said body layers including a plurality of vinyl strips registered about said opposed open end portions of said body respectively, an inner one of said body layers being formed from non-skid rubber material having a unitary and continuous shape extending along an entire length of the axis, a medial one of said body layers being partially interfitted between said inner and outer body layers such that a user can maintain surface area contact with said medial body layer without engaging said outer body layer; and means for tethering said body to a user's wrist such that said apparatus can be maintained within a restricted spatial distance from the user during operating conditions, said tethering means being formed from flexible material adjustably adaptable between alternate lengths.

2. The apparatus of claim 1, wherein said tethering means comprises: a lanyard having oppositely situated looped end portions securely coupled to said body and removably positional about the user's wrist respectively, one said looped end portion having a fixed diameter while another said looped end portion includes a coupling slidably mated to said lanyard such that the user may adapt said another looped end portion between alternate diameters by communicating said coupling along a length of said lanyard.

3. The apparatus of claim 2, wherein said body is provided with an aperture juxtaposed with one said end portions thereof for receiving said lanyard therethrough.

4. The apparatus of claim 1, wherein said medial body layer is formed from impact-absorbent foam and has a thickness greater than associated thicknesses of said outer and inner body layers.

5. An apparatus for providing weightlifters a secure gripping surface when handling a dumbbell and the like, said apparatus comprising:

a body having a deformably resilient cylindrical shape provided with a centrally disposed longitudinal axis extending along a length thereof, said body further having open end portions and an axial bore formed therebetween for defining a sleeve through which the dumbbell can be slidably registered, said body further having separable longitudinal edge portions adapting said body between expanded and equilibrium arrangements such that said apparatus can be nested about the dumbbell; and means for tethering said body to a user's wrist such that said apparatus can be maintained within a restricted spatial distance from the user during operating conditions, said tethering means being formed from flexible, elastic material adjustably adaptable between alternate lengths;

wherein said tethering means comprises: a lanyard having oppositely situated looped end portions securely coupled to said body and removably positional about the user's wrist respectively, one said looped end portion having a fixed diameter while another said looped end portion includes a coupling slidably mated to said lanyard such that the user may adapt said another looped end portion between alternate diameters by communicating said coupling along a length of said lanyard;

wherein said body comprises: a plurality of monolithically formed layers having varying thicknesses respectively, an outer one of said body layers including a plurality of vinyl strips registered about said opposed end portions of said body respectively, an inner one of said body layers being formed from non-skid rubber material having a unitary and continuous shape extending along an entire length of the axis, a medial one of said body layers being partially interfitted between said inner and outer body layers such that a user can maintain surface area contact with said medial body layer without engaging said outer body layer;

wherein said medial body layer is formed from impact-absorbent foam and has a thickness greater than associated thicknesses of said outer and inner body layers.

6. The apparatus of claim 5, wherein said body is provided with an aperture juxtaposed with one said end portions thereof for receiving said lanyard therethrough.

7. An apparatus for providing weightlifters a secure gripping surface when handling a dumbbell and the like, said apparatus comprising:

a body having a deformably resilient cylindrical shape provided with a centrally disposed longitudinal axis extending along a length thereof, said body further having opposed open end portions and an axial bore formed therebetween for defining a sleeve through which the dumbbell can be slidably registered, said body further having separable longitudinal edge portions adapting said body between expanded and equilibrium arrangements such that said apparatus can be nested about the dumbbell, said longitudinal edge portions extending parallel to each other and maintaining a uniform spatial relationship when said body is at equilibrium, wherein said body comprises: a plurality of monolithically formed layers having varying thicknesses respectively, an outer one of said body layers including a plurality of vinyl strips registered about said opposed open end portions of said body respectively, an inner one of said body layers being formed from non-skid rubber material having a unitary and continuous shape extending along an entire length of the axis, a medial one of said body layers being partially interfitted between said inner and outer body layers such that a user can maintain surface area contact with said medial body layer without engaging said outer body layer; and means for tethering said body to a user's wrist such that said apparatus can be maintained within a restricted spatial distance from the user during operating conditions, said tethering means being formed from flexible, elastic material adjustably adaptable between alternate lengths.

8. The apparatus of claim 7, wherein said tethering means comprises:

a lanyard having oppositely situated looped end portions securely coupled to said body and removably positional about the user's wrist respectively, one said looped end portion having a fixed diameter while another said looped end portion includes coupling slidably mated to said lanyard such that the user may adapt said another looped end portion between alternate diameters by communicating said coupling along a length of said lanyard.

9. The apparatus of claim 8, wherein said body is provided with an aperture juxtaposed with one said end portions thereof for receiving said lanyard therethrough.

10. The apparatus of claim 7, wherein said medial body layer is formed from impact-absorbent foam and has a thickness greater than associated thicknesses of said outer and inner body layers.

* * * * *